US009732583B2

(12) United States Patent
Britt et al.

(10) Patent No.: US 9,732,583 B2
(45) Date of Patent: Aug. 15, 2017

(54) COMPLETION SYSTEMS WITH FLOW RESTRICTORS

(71) Applicants: John E. Britt, Houston, TX (US); David S. Bishop, Houston, TX (US); Kirby G. Schrader, Magnolia, TX (US); Marc N. Samuelson, Houston, TX (US)

(72) Inventors: John E. Britt, Houston, TX (US); David S. Bishop, Houston, TX (US); Kirby G. Schrader, Magnolia, TX (US); Marc N. Samuelson, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/604,409

(22) Filed: Jan. 23, 2015

(65) Prior Publication Data

US 2016/0215576 A1 Jul. 28, 2016

(51) Int. Cl.

| | |
|---|---|
| ***E21B 23/00*** | (2006.01) |
| ***E21B 33/128*** | (2006.01) |
| ***E21B 23/06*** | (2006.01) |

(52) U.S. Cl.

CPC ..... *E21B 33/1285* (2013.01); *E21B 23/06* (2013.01)

(58) Field of Classification Search

CPC ..... E21B 23/00; E21B 23/01; E21B 23/02; E21B 23/06; E21B 23/10

USPC ..... 166/313, 369, 381, 382, 297, 179, 118, 166/127, 131, 386

See application file for complete search history.

(56) References Cited

U.S. PATENT DOCUMENTS

| | | | | |
|---|---|---|---|---|
| 2,822,048 A * | 2/1958 | Tausch | E21B 43/14 | 166/114 |
| 2,831,539 A * | 4/1958 | En Dean | E21B 34/16 | 166/116 |
| 2,982,357 A * | 5/1961 | Kenneday | E21B 43/14 | 166/114 |
| 3,003,564 A * | 10/1961 | Smink | E21B 43/14 | 166/114 |
| 3,170,518 A * | 2/1965 | Brown | E21B 43/14 | 166/119 |

(Continued)

FOREIGN PATENT DOCUMENTS

WO 2012082305 A2 6/2012

OTHER PUBLICATIONS

ISR/WO International Application No. PCT/US2016/014428. Mailed Apr. 14, 2016. (14 pgs).

*Primary Examiner* — James G Sayre
(74) *Attorney, Agent, or Firm* — Cantor Colburn LLP

(57) ABSTRACT

A method of completing a wellbore is disclosed that in one non-limiting embodiment includes: placing a lower completion assembly that includes a flow device to provide fluid communication between the lower completion assembly and a production zone associated with the lower completion assembly; placing an isolation assembly with a packer above the lower completion assembly for isolating an annulus between the lower completion assembly and the wellbore; placing a flow restriction device above the packer; setting the flow restriction device in the annulus to restrict flow of fluid through the annulus; and setting the packer after setting the flow restriction device.

16 Claims, 4 Drawing Sheets

(56) References Cited

U.S. PATENT DOCUMENTS

| | | | | |
|---|---|---|---|---|
| 8,925,631 | B2 * | 1/2015 | Patel | E21B 23/00 166/250.01 |
| 2010/0212895 | A1 | 8/2010 | Vickery et al. | |
| 2013/0255947 | A1 | 10/2013 | Frisby et al. | |
| 2013/0319658 | A1 * | 12/2013 | Huh | E21B 33/13 166/250.01 |
| 2014/0034336 | A1 * | 2/2014 | Jasek | E21B 43/04 166/387 |
| 2014/0076546 | A1 | 3/2014 | Patel | |

* cited by examiner

COMPLETION SYSTEMS WITH FLOW RESTRICTORS

BACKGROUND

1. Field of the Disclosure

This disclosure relates generally to apparatus and methods for completing wellbores for production of hydrocarbons from subsurface formations.

2. Background of the Art

Wellbores or wells are drilled in subsurface formations for the production of hydrocarbons (oil and gas) trapped in various zones at different depths. A completion assembly (sometimes referred to as the "lower completion assembly") is placed inside the wellbore that includes packers that isolate production zones, sand screens to prevent flow of solid particles from the formation into the wellbore and flow devices, such as sleeve valves for treating the zones before production and production valve that allow the formation fluid to flow from their associated zones into wellbore. When the lower completion assembly is placed for the production of formation fluids, the production valves are closed so that the formation fluid does not flow to the inside of the lower completion assembly. Typically, there are several thousand feet of non-productive wellbore above the completion assembly. Before opening the production valves in the lower assembly, an isolation assembly is placed above the lower completion assembly. A packer is set in the annulus (space) between the isolation assembly and the lower completion to prevent flow of fluids though such annulus. The annulus, however, is filled with a fluid having a density that provides pressure inside the wellbore greater than the pressure in the formation along the entire depth of the wellbore to prevent blow outs. This fluid can flow from the inside of the lower completion assembly into the formation when the production valves are open. To place the isolation assembly, the production valves are opened before setting the packer, which causes the wellbore fluid to flow through the annulus around the unset packer into the formation, causing fluid loss and can also contain debris. This fluid flow is undesirable as it can hinder the setting of the packer and result in fluid loss from the wellbore into the production zones. It is therefore desirable to provide apparatus and methods to mitigate the effect of such fluid flow during the setting of the packer on the isolation assembly.

The disclosure herein provides apparatus and methods to restrict the flow of the fluid through an annulus between a completion assembly and the wellbore during isolating an annulus between the isolation assembly and the wellbore.

SUMMARY

In one aspect, a method of completing a wellbore is disclosed that in one non-limiting embodiment includes: placing a lower completion assembly that includes a flow device to provide fluid communication between the lower completion assembly and a production zone associated with the lower completion assembly; placing an isolation assembly with a packer above the lower completion assembly for isolating an annulus between the lower completion assembly and the wellbore; placing a flow restriction device above the packer; setting the flow restriction device in the annulus to restrict flow of fluid through the annulus; and setting the packer after setting the flow restriction device.

In another aspect, an apparatus for completing a wellbore is disclosed that in one non-limiting embodiment includes a lower completion assembly having a flow device that provides fluid communication between the lower completion assembly and a production zone associated with the lower completion assembly, an isolation assembly for placement above the completion assembly, the isolation assembly including a packer to seal an annulus between the wellbore and the isolation assembly, and running tool inside the isolation assembly including a restriction device for restricting flow of a fluid through the annulus.

Examples of the more important features of completion system have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1A:
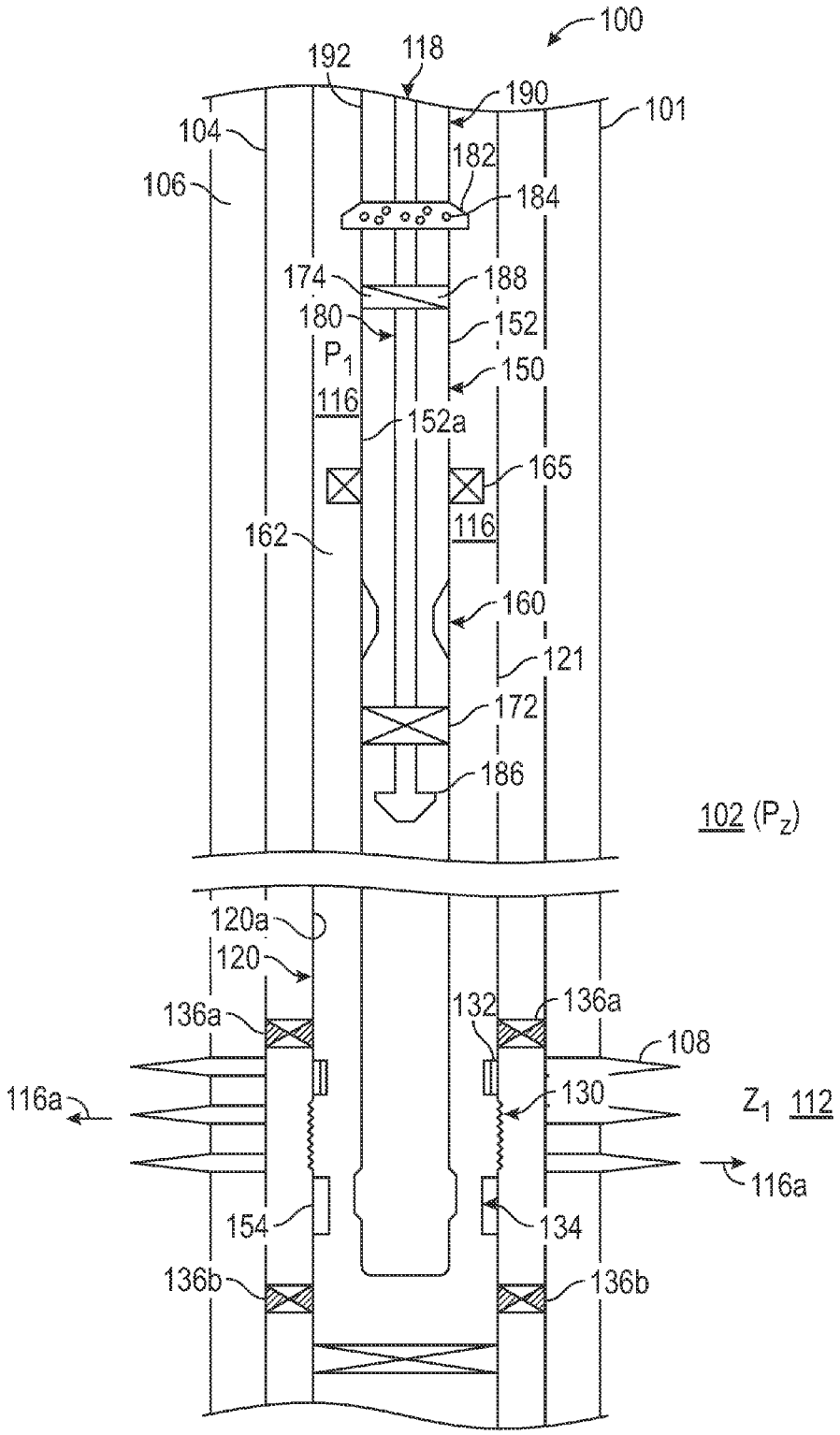
FIG. 1A shows a wellbore system with a lower completion assembly placed therein and an isolation assembly including a flow restriction device and a work string positioned above the lower completion assembly prior to setting the isolation assembly in the wellbore, according one embodiment of the disclosure.

FIG. 1A is a line diagram of wellbore system 100 that includes a wellbore 101 formed in formation 102 for performing a treatment operation and for the production of formation fluids. The system 100 includes a casing 104 placed inside the wellbore and cement 106 between the casing 104 and the wellbore 101. The wellbore 101 is shown to include perforations 108 from the casing 104 into the formation 102 for facilitating flow of the formation fluid 112 into the casing 104. The system 100 includes a completion assembly 120 (also referred to herein as the "lower completion" assembly) that further includes a sand screen 130 and flow devices, such as a frac sleeve or valve 132 and a production sleeve or valve 134. The frac sleeve 132 and the production sleeve 134 are closed after the installation of the lower completion assembly 120 in the wellbore 101. Such sleeves may be opened by a shifting tool when desired to allow flow of fluid between the formation 102 and inside of the lower completion assembly 120. Packers 136*a* and 136*b* respectively above and below the screen 130 are shown set or in their set positions to isolate a production zone Z1 about the perforations 108. In wellbore 101 as shown in FIG. 1B, opening the production sleeve 134 establishes fluid communication between the formation fluid 112 and inside 120*a* of the lower completion assembly 120.

After installation of a lower completion assembly, such as assembly 120, an isolation assembly 150 on a production tubing 152 is placed above the lower completion assembly 120 to produce or move the formation fluid 112 to the surface through the production sleeve 134 and the production tubing 152. In a non-limiting embodiment, the isolation assembly 150 includes a flow valve, such as a parallel flow valve 160 (shown closed), that when open establishes a flow communication between an annulus 162 between the tubing 121 above the lower completion assembly 120 and the isolation assembly inside 152*a*. The isolation assembly 150 further includes a packer 165 (shown not set) which when set seals fluid flow through the annulus 162 about the packer 165. The isolation assembly 120 further includes a tubing valve 172 (shown open) below the flow valve 160 and a wet connect 174 above the tubing valve 172. The isolation assembly 150 also includes a device, such as a shifting device 154, to open the production sleeve 134 as described later. During run in of the isolation assembly 150 into the wellbore, the flow valve 160 is closed; the tubing valve 172 is open; and the packer 165 is not set.

In the system 100, the packer 165 is set after opening the production sleeve 134. Since the pressure P1 in the annulus 162 is greater than the pressure PZ of the fluid 112 in the formation 102 due to the weight of the fluid 116 in the wellbore, a fluid loss can occur from the annulus 162 to the zone Z1 via the open production sleeve 134 as shown by arrows 116*a*. Fluid flowing through the annulus 162 while setting the packer can make it difficult to properly set the packer 165, such as requiring more fluid pressure to set the packer, or in some cases may not allow the packer to completely seal the annulus 162. To mitigate such affects, in one non-limiting embodiment the flow through the annulus 162 is restricted or blocked as described in reference to FIG. 1B.

Figure 1B:
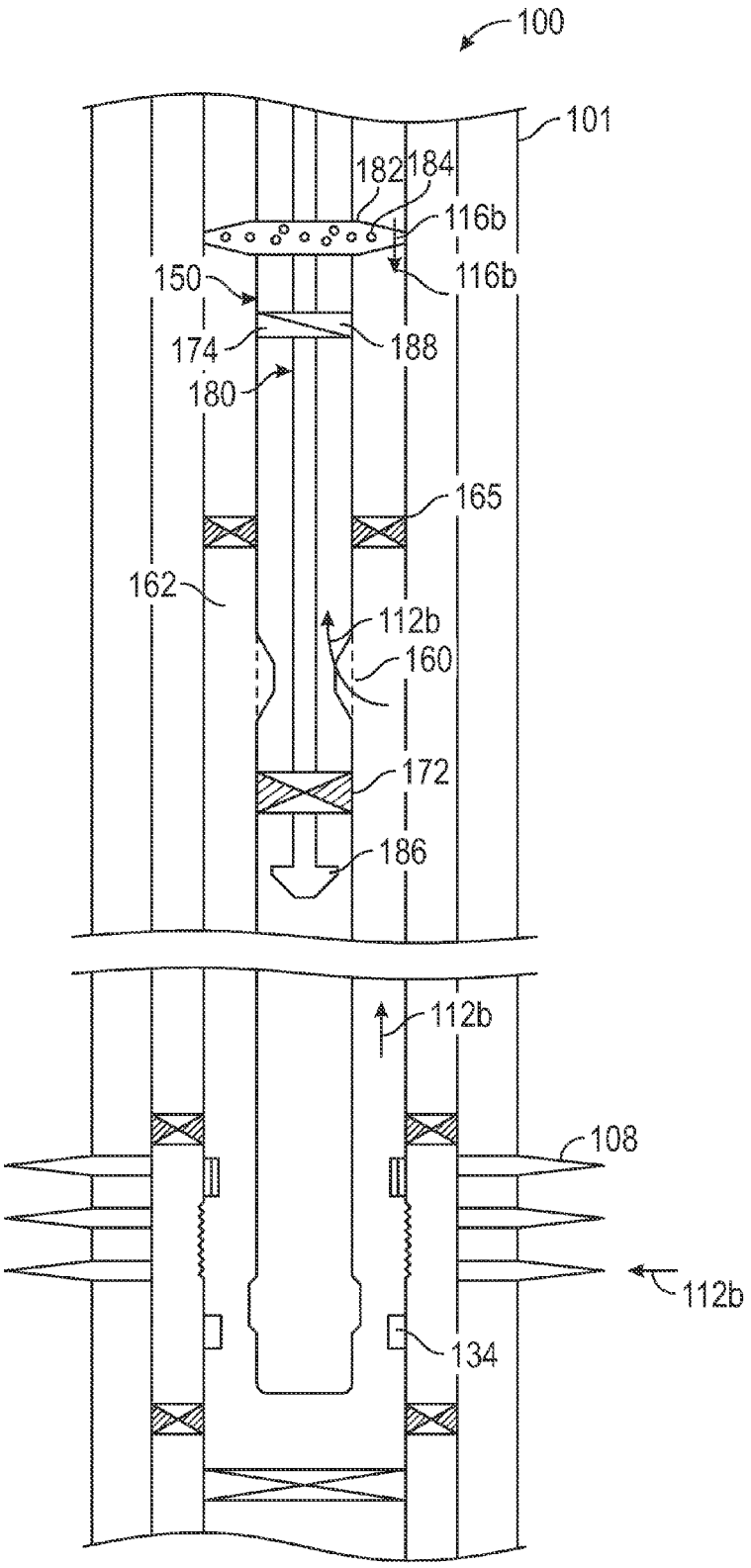
FIG. 1B shows the wellbore system of FIG. 1 after the isolation assembly has been set and before removing the work string and the flow restriction device from the well bore.

Still referring to FIG. 1, to facilitate the setting of the packer 165, a running tool 180 containing a flow restriction device (also referred to herein as a "restrictor") 182 is run in the isolation assembly 150. The running tool 180 is positioned in the isolation assembly 150 so that the restriction device 180 is above the packer 165. The restriction device 182 is run in the unset or deactivated state, as shown in FIG. 1A. The restriction device 182 when set, restricts the flow of the fluid through the annulus 162 and thus can facilitate the setting of the packer 165. In a non-liming embodiment, the restriction device 182 includes one or more flow passages 184 that enable a relatively small amount of fluid to flow through or across the restriction device 182 after it is set as described in reference to FIG. 1B. In one non-limiting embodiment, the running tool 180 also includes a shifting tool 186 for closing the valve 172 and for performing other desired operations relating to the setting of the packer 165. A latch 188 is provided to latch the running tool 180 to the isolation assembly 150. Exemplary restriction devices that may be utilized in the isolation assembly 120 are described in reference to FIGS. 3A, 3B, 4A and 4B.

Referring now to FIGS. 1A and 1B, before setting the packer 165, the production sleeve 134 is opened by the shifting sleeve or tool 154, which establishes fluid communication between zone Z1 and the annulus 162. Since the flow valve 160 is closed, fluid does not flow from the annulus 162 into the isolation assembly 150 via the flow valve 160. In one non-limiting embodiment, the restriction device 182 and the packer 165 are hydraulically-set devices, wherein the restriction device 182 sets or is activated at a pressure lower than the setting pressure of the packer 165. For example, the restriction device 182 may be configured to set at a pressure between 1000 to 2000 psi less than the setting pressure of the packer 165. In such a case, pressure of a fluid 118 supplied into the tubing 152 may be gradually increased to cause the restriction device 182 to set first (as shown by expanded restriction device in FIG. 1B) to restrict the flow of fluid 116 through the annulus 162 and then cause the packer 165 to set (as shown by expanded packer and darkened sections in FIG. 1B). Thus, when the packer 165 is being set, the flow of the fluid 116 through the annulus 162 and, thus, around the packer 165, is restricted to facilitate the setting of the packer 165. The amount of the restriction may be controlled by the size of the flow through the passages 184. Thus, the passages 184 may be configured to define the flow through the annulus when the restriction device 182 is set. In another embodiment, the restriction device 182 may be configured to maintain a small gap 116*b* between the restriction device 182 and the isolation assembly 150, thereby providing a flow path 116*b* around the restriction device in the annulus 162. In another embodiment, both the gap 116*b* and passages 184 may be provided. After setting the packer 165, the shifting tool 186 may be utilized to close the tubing valve 172 (shown by darkened sections) and open the flow valve 160 (shown by dotted lines). The running tool 180 may then be removed from the isolation assembly 150 along with the restriction device 182 and latch 188. Once the packer 165 has been set, the formation fluid 112 may be produced to the surface via the open production sleeve 134 and open parallel flow valve 160 as shown by arrows 112*b*.

Figure 2A:
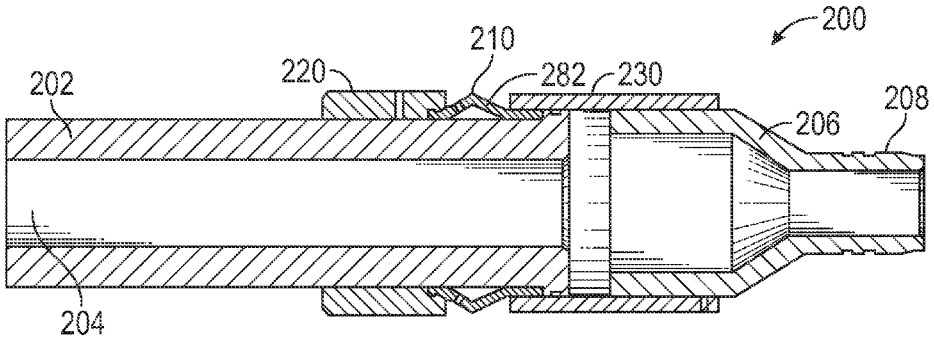
FIG. 2A shows a non-limiting embodiment of a flow restriction device for use in the system or FIG. 1A in the run in position.
Figure 2B:
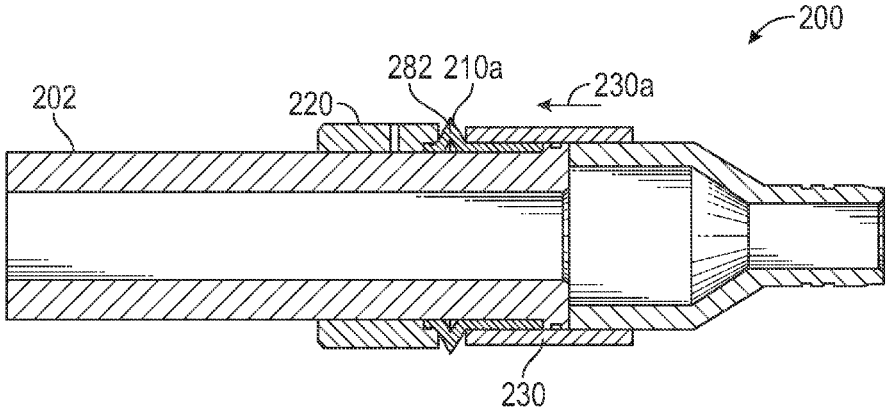
FIG. 2B shows the flow restriction device of FIG. 2A in the set position.

FIG. 2A show a non-limiting embodiment of a restriction device 200 in a run in position or deactivated position for use on a running tool, such as running tool 180 shown in FIG. 1A. The restriction device 200 includes a mandrel 202 with a flow through passage 204. The restriction device includes a back stop 206 and a connection 208. The restriction device further includes an expansion element 210 on the outside of the mandrel 202, which may be a flexible member made from any suitable materials, such as rubber, elastomer, etc. The restriction device 200 further includes an upper connection or member 220 fixed to the mandrel 202 and abuts against an upper end of the expansion member 210. A movable lower connection or member 230 is disposed below the expansion to cause the flexible member 210 to expand radially outward. In one aspect the movable member 230 moves toward the flexible member when a hydraulic pressure is applied inside the flow through passage 204. Referring to FIGS. 2A and 2B, when hydraulic pressure above a selected pressure is applied to the flow through passage 204 of the restrictor 200, the movable member 230 moves upward (toward the expandable member 210) as shown by arrow 230*a*, causing the expansion member 210 to expand as shown in FIG. 2B. The member 210 may be configured to contact the inside of the completion assembly tubing 121 or to maintain a selected gap 116*a* between the member 210 and the tubing 121 as shown in FIG. 1B. The member 210 may include one or more passages 282 to allow a selected amount of fluid to pass through such passages. When the expansion member 210 expands, it restricts the flow of the fluid through the annulus 162 shown in FIG. 1B.

Figure 3A:
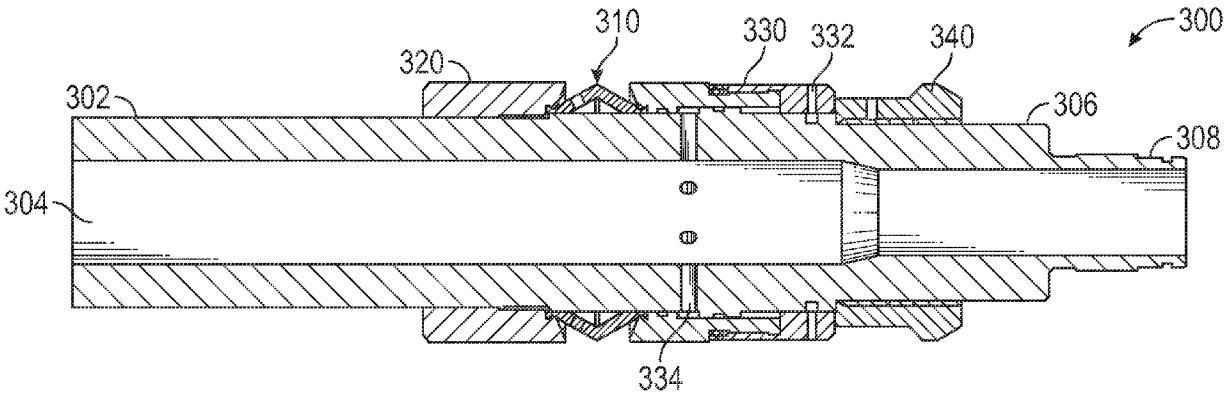
FIG. 3A shows a another non-limiting embodiment of a flow restriction device for use in the system of FIG. 1A in the run in position.
Figure 3B:
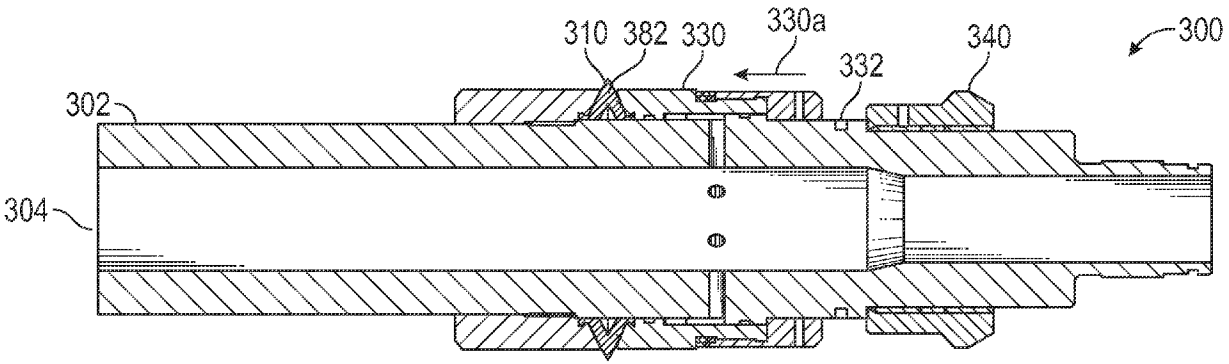
FIG. 3B shows the flow restriction device of FIG. 3A in the set position.

FIG. 3A shows a non-limiting embodiment of a restriction device 300 in a run in position or deactivated position for use on a running tool, such as running tool 180 shown in FIG. 1A. The restriction device 300 includes a mandrel 302 with a flow through passage 304. The restriction device 300 includes a back stop 306 and a connection 308. The restriction device 300 further includes an expansion element 310 on the outside of the mandrel 302, which may be a flexible member made from any suitable materials, such as rubber, elastomer, etc. The restriction device 300 further includes an upper connection or member 320 fixed to the mandrel 302 and abuts against an upper end of the expansion member 310. A movable lower connection or member 330 placed below the expansion element 310 to causes the expansion element 310 to expand radially outward. A lower connection 340 provided on the mandrel 302 below the movable member 330 supports the movable member 310. In one aspect the movable member 330 moves toward the expansion element 310 when hydraulic pressure above a selected or predetermined value is applied inside the flow through passage 304. Referring to FIGS. 3A and 3B, when the hydraulic pressure above the selected pressure is applied to the flow through passage 304 of the restrictor 300, the movable member 330 moves upward (toward the expandable element 310) as shown by arrow 330*a*, causing the pin 332 to break and cause the expandable element 310 to expand as shown in FIG. 3B. The expandable element 310 may be configured to contact the inside of the completion assembly tubing 121 or to maintain a selected gap 116*a* between the expanded element 310 and the tubing 121 as shown in FIG. 1B. The expandable element 310 may include one or more passages 382 to allow a selected amount of fluid to pass through such passages. When the expansion element 310 expands, it restricts the flow of the fluid through the annulus 162 shown in FIG. 1B. Although the restriction devices described herein are hydraulically operated devices, such devices may be mechanically set devices, electrically set devices or set by another mechanism. Further, any suitable device that will restrict the fluid through the annulus in which the packer is to be set may be utilized.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of completing a wellbore, comprising:

placing a lower completion assembly that includes a flow device that provides fluid communication between the lower completion assembly and a production zone surrounding the lower completion assembly;

placing an isolation assembly with a packer above the lower completion assembly for isolating an annulus between the lower completion assembly and the wellbore;

placing a flow restriction device above the packer, wherein the flow restriction device includes a mandrel and an expandable element around an outside of the mandrel;

setting the flow restriction device in the annulus to restrict flow of fluid through the annulus via at least one of a fluid passage of the flow restriction device and a gap of the flow restriction device, at a selected restricted rate; and setting the packer after setting the flow restriction device.

2. The method of claim 1 further comprising opening the flow device prior to setting the flow restriction device.

3. The method of claim 1, wherein setting the flow restriction device comprises:

running in the flow restriction device with a running tool;

setting the flow restriction device by one of: hydraulically; mechanically; and electrically.

4. The method of claim 1, wherein setting the packer comprises setting the packer by one of: hydraulically; mechanically; and electrically.

5. The method of claim 1, wherein the isolation assembly includes a tubing valve, a flow valve above the tubing valve and the packer above the flow valve, wherein the method further comprises placing the isolation assembly with the tubing valve open, flow valve closed and packer unset.

6. The method of claim 1, wherein the flow restriction device is a hydraulic flow restriction device, the packer is a hydraulic packer that sets hydraulically at selected pressure above a setting pressure of the hydraulic flow restriction device, the method further comprising:

running in a running tool having the hydraulic flow restriction device in the isolation assembly;

supplying a fluid into the wellbore;

increasing pressure of the supplied fluid to a first pressure to set the hydraulic flow restriction device and then to a second pressure to set the hydraulic packer, wherein the second pressure is greater than the first pressure.

7. The method of claim 6 further comprising:

closing the tubing valve after the setting of the packer; and unsetting the flow restriction device; and;

pulling the running tool from the wellbore along with the flow restriction device.

8. The method of claim 1, wherein the wellbore is one of: an open hole and cased hole.

9. The method of claim 1, wherein the packer is a hydraulic packer, the restriction device is a hydraulic restriction device, and the hydraulic restriction device sets at a hydraulic pressure less than a hydraulic setting pressure of the hydraulic packer.

10. A method of completing a wellbore having a lower completion assembly that includes a flow device that provides fluid communication between the lower completion assembly and a production zone surrounding the lower completion assembly, the method comprising:

placing an isolation assembly with a packer above the lower completion assembly for isolating an annulus between the lower completion assembly and the wellbore;

running in a running tool having a flow restriction device thereon above the packer, wherein the flow restriction device includes a mandrel and an expandable element around an outside of the mandrel;

setting the flow restriction device in the annulus to restrict flow of fluid through the annulus via at least one of a fluid passage of the flow restriction device and a gap of the flow restriction device, at a selected restricted rate; and setting the packer after setting the flow restriction device.

11. An apparatus for use in completing a wellbore, comprising:

a lower completion assembly having a flow device that provides fluid communication between the lower completion assembly and a production zone associated with the lower completion assembly;

an isolation assembly for placement above the completion assembly, the isolation assembly including a packer to seal an annulus between the wellbore and the isolation assembly; and a running tool inside the isolation assembly including a restriction device for restricting flow of a fluid through the annulus via at least one of a fluid passage of the restriction device and a gap of the restriction device, at a selected restricted rate, wherein the restriction device includes a mandrel and an expandable element around an outside of the mandrel.

12. The apparatus of claim 11, wherein the restriction device includes a flexible member configured to expand radially outward to restrict the flow of the fluid through the annulus.

13. The apparatus of claim 11, wherein the restriction device further comprises:

a setting device configured to compress the expandable element to expand the expandable element radially outward to restrict flow of the fluid through the annulus.

14. The apparatus of claim 11, wherein the isolation assembly includes a tubing valve, a flow valve above the tubing valve and the packer above the flow valve and wherein the isolation assembly is run in the wellbore with the tubing valve open, flow valve closed and the packer unset.

15. The apparatus of claim 14, wherein the running tool further includes a shifting tool for closing the tubing valve and opening the flow device in the isolation assembly.

16. An apparatus for use in a wellbore filled with a fluid and has a completion assembly that includes a flow device that provides fluid communication between the completion assembly and a production zone surrounding the completion assembly, comprising:

an isolation assembly for placement above the completion assembly, the isolation assembly including a packer to seal an annulus between the wellbore and the isolation assembly; and a running tool inside the isolation assembly including a restriction device for restricting flow of a fluid through the annulus via at least one of a fluid passage of the restriction device and a gap of the restriction device, at a selected restricted rate, wherein the restriction device includes a mandrel and an expandable element around an outside of the mandrel.

* * * * *